United States Patent [19]

Jensen

[11] Patent Number: 4,974,573

[45] Date of Patent: Dec. 4, 1990

[54] INTAKE MANIFOLD FUEL MULTI-LAYER ATOMIZING SCREEN

[76] Inventor: Millard J. Jensen, 11428 Oak Tree, Balch Springs, Tex. 75180

[21] Appl. No.: 452,003

[22] Filed: Dec. 18, 1989

[51] Int. Cl.[5] ..... F02M 29/04

[52] U.S. Cl. ..... 123/593; 48/189.4

[58] Field of Search ..... 123/593; 48/189.4

[56] References Cited

U.S. PATENT DOCUMENTS

| | | | |
|---|---|---|---|
| 1,315,758 | 9/1919 | Brown | 123/593 |
| 1,523,524 | 1/1925 | Harvey | 123/593 |
| 1,623,053 | 4/1927 | Howard et al. . | |
| 3,682,608 | 8/1972 | Hicks | 48/108 R |
| 3,747,581 | 7/1973 | Kolb | 123/593 |
| 4,015,575 | 4/1977 | Fox | 123/593 |
| 4,031,876 | 6/1977 | Hoots | 123/593 |
| 4,071,044 | 1/1978 | Jones | 137/479 |
| 4,088,104 | 5/1978 | Ibbott | 123/593 |
| 4,114,580 | 9/1978 | Coats | 123/593 |
| 4,285,320 | 8/1981 | Webster et al. | 123/593 |
| 4,306,519 | 12/1981 | Schoenhard | 123/25 R |
| 4,359,035 | 11/1982 | Johnson | 123/593 |
| 4,361,128 | 11/1982 | Goldman et al. | 123/593 |
| 4,452,214 | 6/1984 | Dahl | 123/523 |
| 4,702,220 | 10/1987 | Roe | 123/593 |

FOREIGN PATENT DOCUMENTS 1476178 9/1969 Fed. Rep. of Germany ..... 123/593

*Primary Examiner*—E. Rollins Cross

*Attorney, Agent, or Firm*—Warren H. Kintzinger

[57] ABSTRACT

A multi-layered screen with layers closely spaced positioned for use in carburetor equipped internal combustion motors in the manifold openings beneath the carburetor in the path of intake air flow with, under a one-barrel carburetor one multi-layered screen being used, with a two-barrel carburetor one or two multi-layered screen units are used depending on whether one barrel is a kick in barrel for acceleration, and in a four-barrel carburetor two are used for the normal run barrels with none in the two kick in barrels that come into use for heavy acceleration. The multi-layered screen units in concentric cylinder form, concentric truncated conical form or spiral wound form, are positioned so that fuel laden air from the carburetor passes through screening of the multi-layered screen units with the mesh and wire size of the screening coupled with the shape and close adjacency of the multi-layers of each screen unit such as to optimize vaporization atomizing of fuel in the fuel air mixture being fed to the motor.

19 Claims, 2 Drawing Sheets

INTAKE MANIFOLD FUEL MULTI-LAYER ATOMIZING SCREEN

Figure 1:
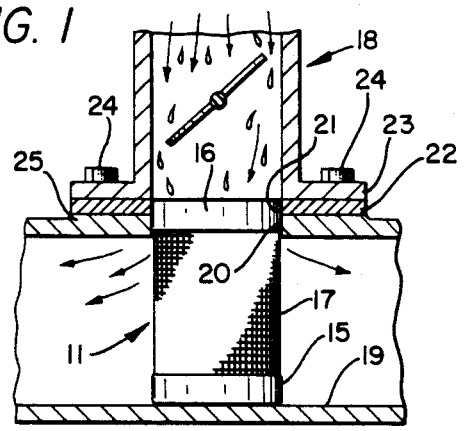

This invention relates in general to vaporization of liquid fuel fed to internal combustion motors and, in particular, to liquid fuel vaporizing multi tightly layered screen units used singly or in multiple depending upon whether a carburetor is a one-barrel or multi-barrel carburetor feeding corresponding intake manifold openings. Each multi-layered screen unit is positioned in a manifold intake opening such that fuel laden air from the carburetor passes through the closely spaced screen layers of the multi-layered screen units with screen mesh and wire size coupled with screen unit size and shape such as to optimize vaporization atomizing of fuel in the fuel air mixture being fed to the motor.

Fuel economy is an increasingly important consideration in vehicles, particularly with present energy problems and fuel shortages and constantly increasing fuel costs. Further, present day problems of environmental pollution have resulted in legislative action requiring more efficient internal combustion motors with less pollution to meet tighter emission standards. In meeting such standards, exhaust gas recirculation, catalytic converters and/or auxiliary pumps and other associated controls are designed into vehicles, both passenger cars and trucks, resulting in greatly increased vehicle costs. Still further, addition of such additional pollution control equipment is a further drain on the vehicle motor further decreasing efficiency. Obviously, if motor efficiency can be increased to the point that pollution control devices are no longer needed in meeting tightened pollution standards still further increases in efficiency are attainable through the lessened power loading with removal of driven equipment. If motor efficiency is such that catalytic converters and/or other pollution control devices are not needed then the range of fuels useable is expanded and the motor may be tuned for optimum motor efficiency and not for optimized pollution control device efficiency.

With motors employing conventional carburetors for fuel vaporization a portion of the intake air is used to break the fuel into fine droplets. Since droplet size varies with intake air speed and intake air speed varies over a wide range droplet size varies from smaller droplets at higher intake air speeds to larger droplets at lower intake air speeds. It should be noted that there is some beneficial gasification of the fuel in the carebuetor and delivery through intake manifolding. However, much of the fuel remains in the form of droplets of varying sizes passed into the intake manifold with much of air fuel mixing occurring downstream from the carburetor resulting in uneven cylinder to cylinder to cylinder distribution. More complete vaporization of the fuel leads to more uniform mixing of fuel with air in the carburetor area and through the motor intake manifold. Further, the more completely fuel is transformed to a vapor as opposed to a mist droplet state the efficiency of combustion in the cylinder is improved.

It is, therefore, a principal object of this invention to provide improved motor fuel feed gas vaporization.

Another object is to attain increased vehicle mileage with reduced emission pollution.

A further object is to so increase vehicle internal combustion motor efficiency as to permit removal of emission pollution control devices and still meet tightened emission pollution standards.

Features of this invention useful in accomplishing the above objects include a carburetor mounted on an intake manifold of an internal combustion motor with a multi-layered screen unit mounted in at least one intake manifold opening held in place with the bottom of each screen unit resting on the inside bottom of the intake manifold and the top held in the top of the intake manifold opening and the opening through the carburetor mounting gasket aligned therewith. Each screen unit is a multi-layered screen with layes closely spaced positioned for use in the carburetor equipped internal combustion motors in the manifold openings beneath the carburetor in the path of intake air flow with, under a one-barrel carburetor one multi-layered screen being used, with a two-barrel carburetor one or two multi-layered screen units are used depending on whether one barrel is a kick in barrel for acceleration, and in a four-barrel carburetor two are used for the normal run barrels with none in the two kick in barrels that come into use for heavy acceleration. The multi-layered screen units in concentric cylinder form, concentric truncated conical form or spiral wound form, are positioned so that fuel laden air from the carburetor passes through screening of the mult-layered screen units with the mesh and wire size of the screening coupled with the shape and close adjacency of the multi-layers of each screen unit such as to optimize vaporization atomizing of fuel in the fuel air mixture being fed to the motor.

Specific embodiments representing what are presently regarded as the best modes of carrying out the invention are illustrated in the accompanying drawings.

Figure 7:
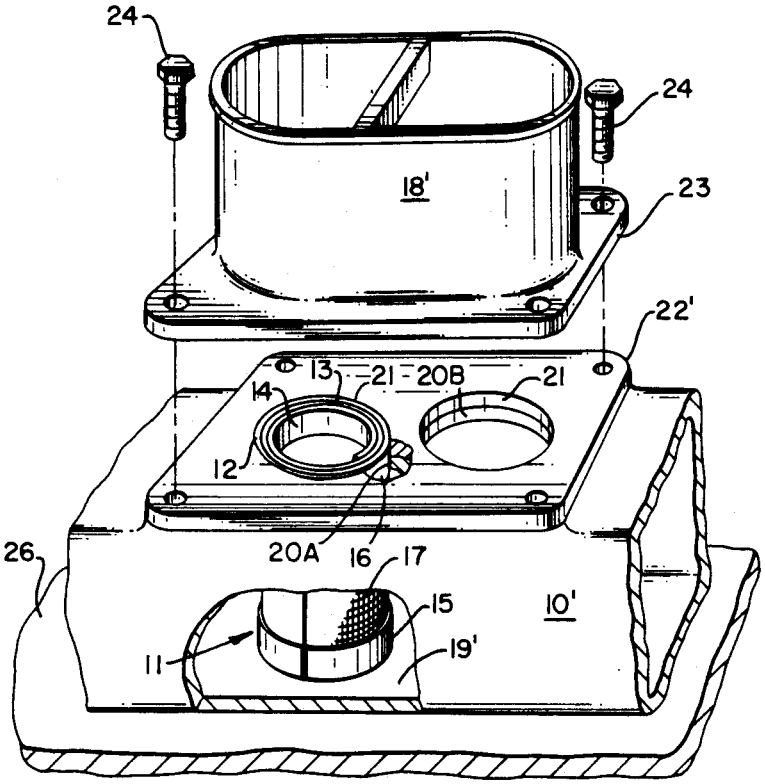
Figure 2:
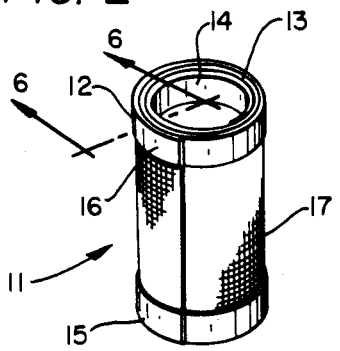
Figure 3:
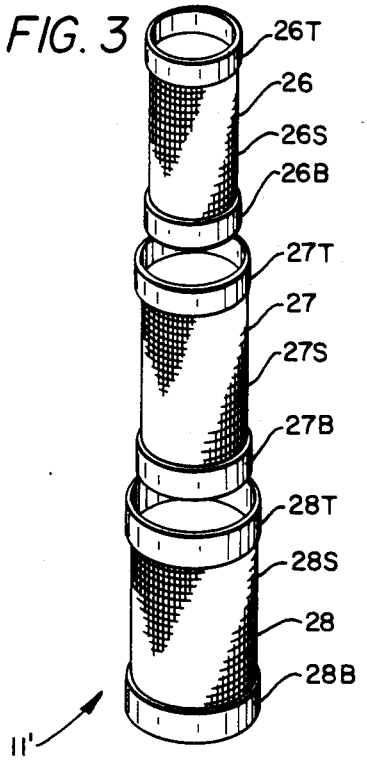
Figure 4:
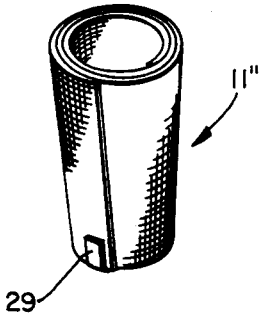
Figure 5:
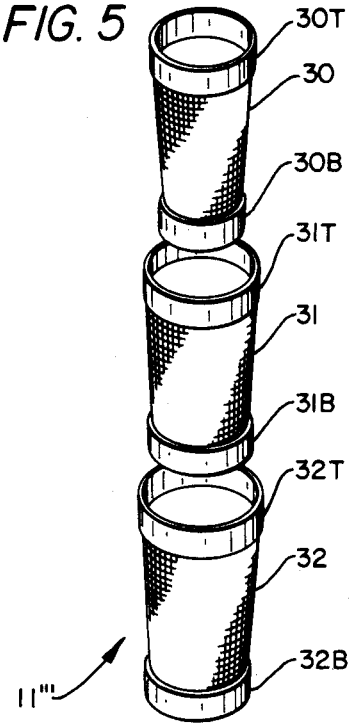
Figure 6:
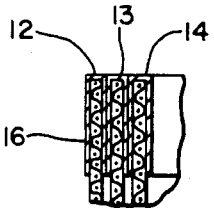

In the drawings:

FIG. 1 represents a partial cut away and sectioned view of a carburetor mounted on an intake manifold of an internal combustion motor with an air flow passing and liquid fuel droplet vaporizing multi-layered screen unit positioned with the unit resting on the inside bottom of the intake manifold and the top held in the top of the intake manifold opening and the opening through the carburetor gasket;

FIG. 2, a perspective view of the multi-layered wrapped on itself screen unit used in the carburetor intake manifold assembly of FIG. 1;

FIG. 3, an exploded perspective of a multi-layered concentric cylinder screen unit useable in place of the multi-layered screen unit of FIGS. 1 and 2;

FIG. 4, a perspective view of a multi-layered wrapped on itself truncated cone screen unit;

FIG. 5, an exploded perspective of a multi-layered truncated cone screen unit made up of nested truncated cone screens;

FIG. 6, a sectioned view taken along line 6—6 of FIG. 2 showing detail of folded over spacer banding on the top of a screen unit; and, FIG. 7, an exploded perspective view of a two barrel carburetor and intake manifold combination using two multi-layered screen units.

Referring to the drawings:

The intake manifold 10 fuel atomizing screen unit 11 of FIGS. 1, 2 and 7 is shown to be a multi-layered 12, 13 and 14 wrapped on itself generally cylindrical screen unit 11 with a fold ®d over spacer band 15 on the bottom and a folded over spacer band 16 at the top of wrapped around screen sheet 17. The fuel atomizing screen unit 11 is shown to be held in place in the one barrel carburetor 18 and intake manifold 10 combination of FIG. 1 with the bottom spacer band 15 and resting on the inside of bottom 19 of the manifold 10 and the upper spacer band 16 end held in manifold carburetor intake opening 20 and gasket opening 21 in carburetor gasket 22. Referring also to FIG. 6 the folded over top spacer band 16 (and like band 15 at the bottom) aid in maintaining a closely spaced relation between layers 12, 13 and 14 of the wrapped around screen sheet 17 in the generally cylindrical fuel atomizing screen unit 11 such that vaporization and conversion of large fuel droplets to small mist like droplets is optimized. The carburetor gasket 22 is clamped under the mounting flange 23 of carburetor 18, fastened by bolts 24 to the carburetor mounting base 25 of the intake manifold 10. The fuel atomizing screen unit 11 is also useable in one or both intake openings 20A and 20B of a two barrel carburetor 18' gasket 22' and intake manifold 10' with the bottom 19' that rests on a heated portion 26 of a vehicle motor or exhaust manifold. Such multi-layered screen units 11 could also be used in the front two intake manifold openings of the four openings under a four barrel carburetor (not shown).

Alternate embodiment multi-layered fuel atomizing screen units 11', 11'' and 11''', respectively, of FIGS. 3, 4 and 5 may be used in place of screen units 11 in one two and four barrel carburetors. The screen units 11' are multi-layered screen units with concentric cylinders 26,27 and 28 with screen mesh, respectively, being, for example seventy, eighty and ninety mesh screens inner to outer cylinder so that the open area for the through flow of air and fuel mixture be balanced and fuel vaporization and misting to small droplets be optimized. It should be realized however, that each cylinder could have the same mesh size eighty, for example, and still be quite effective in misting and vaporizing fuel in intake air through flow. Each of the concentric cylinders 26, 27, and 28 of a concentric cylinder screen unit 11' is formed, respectively, with folded over spacer bands 26T, 27T and 28T at the top and spacer bands 26B, 27B and 28B at the bottom of screen sheets 26S, 27S and 28S.

The multi-layered fuel atomizing screen unit 11'' of FIG. 4 is a wrapped on itself screen unit in the form of a truncated cone screen unit 11'' that while shown as not having top and bottom folded over spacer bands could be provided with such bands. The clip 29 at the bottom helps maintain the screen wrapped on itself state. Referring now to the multi-layered fuel atomizing screen unit 11''' of FIG. 5 nested truncated cone screens 30, 31 and 32 are used and include folded over space bands 30T, 31T and 32T at the top and spacer bands 30B, 31B and 32B at the bottom. It should be noted that the flattened pattern form for the wrapped on itself screen 33 of screen unit 11'' of FIG. 4 is acuate in flat form to form the truncated cone screen unit 11'' when wound on itself. The flattened pattern form of each of the screens 30, 31 and 32 are also each arcuate in flattened shape to form the tuncated cones that nest together. Here again just as with the concentric cylinders 26, 27 and 28 of the screen unit 11' the screen size for each could be a screen mesh, respectively, for example seventy, eighty and ninety mesh screens inner to outer or they could have the same mesh size and still be quite effective in misting and vaporizing fuel in intake air through flow. When any of the various screen units 11, 11', 11'' and 11''' are used the top is held within the carburetor gasket opening 21 and the intake manifold opening 20, 20A or 20B etc., and the bottom of the screen unit rests on the inside bottom surface 19 or 19' etc. that may be subject to being heated by a motor or exhaust manifold portion 26 therebeneath. Various screen sizes may be used in screen units 11, 11', 11'' 11''' ranging from a large mesh size of thirty to as small as two hundred mesh yielding excellent results in vaporizing and misting fuel to intake air flow optimizing vehicle fuel mileage in the range of thirty to sixty percent mileage improvement. Stainless steel wire or copper or other metal or plastic wire screen mesh up to at most coarse a 30–30 mesh screen having up to a maximum wire diameter of 0.020 inches being useable in attaining beneficial increases in vehicle mileage but with finer mesh sizes doing even better. Please note that top and bottoms of screen layers could be folded over in place of folded over spacer bands 16, 26B, 27B and 28B, 26T, 27T and 28T, etc. for desired spacing between screen layers. Further, with deep throated intake manifold carburetor openings truncated cone screen unit embodiments may provide clearance for enhanced through flow of air and air entrained fuel vapor and misted fuel droplets.

Whereas this invention is herein illustrated with respect to several embodiments thereof, it should be realized that various changes may be made without departure from the essential contributions to the art made by the teachings hereof.

I claim:

1. An internal combustion intake manifold multi-layer fuel atomizing and vaporizing screen comprising: a multi-layered screen unit with layers spaced in close adjacency placeable in an internal combustion motor intake manifold; said multi-layered screen unit being sized such that with the bottom of the screen unit resting on the top inside of the bottom floor of the intake manifold the top of the screen unit is held within an intake manifold top opening in the path of intake air and fuel flow to optimize vaporization atomizing of fuel in intake air being passed therethrough.

2. The multi-layer fuel atomizing and vaporizing screen unit of claim 1, wherein spacing means is provided between screen layers of said screen unit.

3. The multi-layer fuel atomizing and vaporizing screen unit of claim 2, wherein the screening of the multi-layer screen unit falls in the range of from a large mesh size of thirty mesh to as small as two hundred mesh size.

4. The multi-layer fuel atomizing and vaporizing screen unit of claim 3, wherein said spacing means is fold over means at the top and at the bottom of said screening.

5. The multi-layer fuel atomizing and vaporizing screen unit of claim 4, wherein said fold over means at the top is a fold over band of the screening; and said fold over means at the bottom is a folded over band of the screening.

6. The multi-layer fuel atomizing and vaporizing screen unit of claim 4, wherein said fold over means at the top is a top folded over spacer band that extends over the top of said screening and down over opposite sides of the top of said screening; and fold over means at the bottom is a bottom folded over spacer band that extends over the bottom of said screening and up over opposite sides of the bottom of said screening.

7. The multi-layer fuel atomizing and vaporizing screen unit of claim 6, wherein said screen unit is a wrapped on itself screen unit to the extent of at least two screen layers generally cylindrical in shape.

8. The multi-layer fuel atomizing and vaporizing screen unit of claim 7, wherein said screen unit is wrapped on itself to the extent of three layers.

9. The multi-layer fuel atomizing and vaporizing screen unit of claim 2, wherein said screen unit is a wrapped on itself screen unit to the extent of at least two screen layers generally cylindrical in shape.

10. The multi-layer fuel atomizing and vaporizing screen unit of claim 9, wherein said screen unit is wrapped on itself to the extent of three layers.

11. The multi-layer fuel atomizing and vaporizing screen unit of claim 3, wherein said screen unit is a multi-layered screen unit of a plurality of concentric closely spaced cylinders of screening.

12. The multi-layer fuel atomizing and vaporizing screen unit of claim 11, wherein the screen mesh size of the concentric cylinders is the same from inner to outer cylinder.

13. The multi-layer fuel atomizing and vaporizing screen unit of claim 12, wherein the screen mesh size varies from a larger mesh size for screening of the innermost concentric cylinder to a smaller finer mesh size for screening of the outermost concentric cylinder in the screen unit.

14. The multi-layer fuel atomizing and vaporizing screen unit of claim 13, wherein the screen unit includes three concentric cylinders with inner, middle and outer cylinders having, respectively, seventy, eighty and ninety mesh screens.

15. The multi-layer fuel atomizing and vaporizing screen unit of claim 1, wherein said multi-layered screen unit is a wrapped on itself screen unit in the form of a truncated cone screen unit with the smaller bottom resting on the intake manifold bottom with the top held in a carburetor opening in the top of the intake manifold.

16. The multi-layer fuel atomizing and vaporizing screen unit of claim 15, wherein spacing means is provided between screen layers of said screen unit; and said spacing means is fold over means at the top and at the bottom of said screening.

17. The multi-layer fuel atomizing and vaporizing screen unit of claim 1, wherein said multi-layered screen unit is a plurality of nested truncated cone screens with the smaller bottom of each resting on the inside surface of the intake manifold bottom with the tops held in carburetor openings in the top of the intake manifold.

18. The multi-layer fuel atomizing and vaporizing screen unit of claim 17, wherein the screen mesh size varies from a larger mesh size for screening of the innermost truncated cone to a smaller finer mesh size for screening of the outermost truncated cone in the screen unit.

19. The multi-layer fuel atomizing and vaporizing screen unit of claim 18, wherein the screen unit includes three truncated cones with inner, middle and outer cones having, respectively, seventy, eighty and ninety mesh screens.

* * * * *